United States Patent [19]

Marquart et al.

[11] 4,441,228

[45] Apr. 10, 1984

[54] DUST MOP

[75] Inventors: Vernon W. Marquart, Hammond, Wis.; Walter W. Pawlikowski, St. Paul, Minn.

[73] Assignee: Minnesota Mining and Manufacturing Company, St. Paul, Minn.

[21] Appl. No.: 441,115

[22] Filed: Nov. 12, 1982

[51] Int. Cl.[3] ..... A47L 13/252

[52] U.S. Cl. ..... 15/229 BP

[58] Field of Search ..... 15/147 R, 228, 229 A, 15/229 AP, 229 AC, 229 B, 229 BP, 229 BC, 229 R

[56] References Cited

U.S. PATENT DOCUMENTS

| | | | |
|---|---|---|---|
| 1,585,006 | 5/1926 | Zell | 15/229 AC |
| 2,790,981 | 5/1957 | Stuvel | 15/229 AC X |
| 3,425,085 | 2/1969 | Moss | 15/229 |
| 3,822,435 | 7/1974 | Moss | 15/299 BP |
| 3,827,099 | 8/1974 | Allaire et al. | 15/229 R |
| 3,962,743 | 6/1976 | Moss | 15/229 AP |
| 4,118,531 | 10/1978 | Hauser | 428/224 |

FOREIGN PATENT DOCUMENTS

| | | | |
|---|---|---|---|
| 1109654 | 9/1981 | Canada | 28/12 |

*Primary Examiner*—Chris K. Moore

*Attorney, Agent, or Firm*—Donald M. Sell; James A. Smith; Richard Francis

[57] ABSTRACT

A dry mop especially adapted for collecting and pushing dust and fine dirt on or from smooth surfaces includes a plurality of dusting elements, a mop frame and fastening means for holding the dusting elements in a side-by-side relationship to the mop frame. Each dusting element comprises a substantially continuous elongate array of repeating segments of at least three ribbon loops of a dusting fabric.

7 Claims, 5 Drawing Figures

DUST MOP

DESCRIPTION

1. Technical Field

The invention relates to a mop including a plurality of dusting elements formed of dusting fabric ribbon loops.

2. Background Art

Various implements are known for removing dirt and dust from smooth surfaces such as floors. Early implements for this purpose were brooms made by fastening a bundle of long thin resilient elements such as straw to a wooden stick or pole. A very popular sweeping implement is the push broom which typically comprises an elongate segment of wood into which a handle is inserted and which is covered on the working surface with erect bristles or a dust mop which consists of a collection of strands of yarn fastened to a fabric backing which has a means for engagement of a handle. Such brooms typically do a respectable job of pushing larger particles of dirt and other debris, but leave residual fine dust and smaller dirt particles behind which must then be removed by utilizing a dust mop typically of the yarn strand type. Dust mops are relatively efficient at this task but their dust collecting capacities are limited and they usually must be treated with oil or similar materials to enhance the dirt holding capacity and pick up ability. Once the dust mop is loaded with dirt, it is typically renewed by shaking or brushing and laundering after the shaking and brushing are no longer effective.

Because of the inconvenience of cleaning soiled mops, rental mops have become popular and disposable mops have become available. Such disposable mops typically consist of a cloth clamped to a block-type holder which has a flat bottom surface to apply a single sheet of dusting material against the floor during use. Such a dust mop is disclosed in assignee's Canadian Pat. No. 1,109,654. The limitations of the block-design dust mop are obvious since the efficiency and performance of such a mop would depend essentially upon the performance of the dusting fabric. Various attempts have been made to expand the surface of the dusting element of a dust mop but they have been difficult to produce and/or expensive or otherwise undesirable. For example, U.S. Pat. No. 3,827,099 (Allaire et al) discloses a disposable mop having a support with a backing face over which are secured a number of elongate flexible sheets of dusting fabric. U.S. Pat. No. 3,425,085 (Moss) discloses a strand-type dusting mop having looped yarns fastened to a backing material.

DISCLOSURE OF THE INVENTION

The present invention provides a mop especially adapted for collecting and pushing dust and fine dirt on and from smooth surfaces, providing a combined function which was previously provided by a push broom and a dust mop. The dust mop of the invention comprises a plurality of dusting elements, each dusting element comprising a substantially continuous elongate array of repeating segments of at least three dusting fabric ribbon loops, a mop frame including a handle, and fastening means for securing the dusting elements in a side-by-side relationship to the mop frame.

The preferred dusting elements comprise dusting fabric folded on itself at a point of attachment with the fastening means to provide at least three elongate parallel fabric loops held together preferably in a fan-like array with each dusting fabric loop being transversely slit to provide a multitude of looped dusting ribbons. In the preferred dust mop at least one-half of the fabric ribbon loops are at least 5 inches long. The width of the fabric ribbon in each loop is preferably at least $\frac{3}{4}$ inch. The preferred dusting fabric is a nonwoven fabric comprising a web of a blend of blown organic microfibers and bulking macrofibers.

BEST MODE FOR CARRYING OUT THE INVENTION

Figure 1:
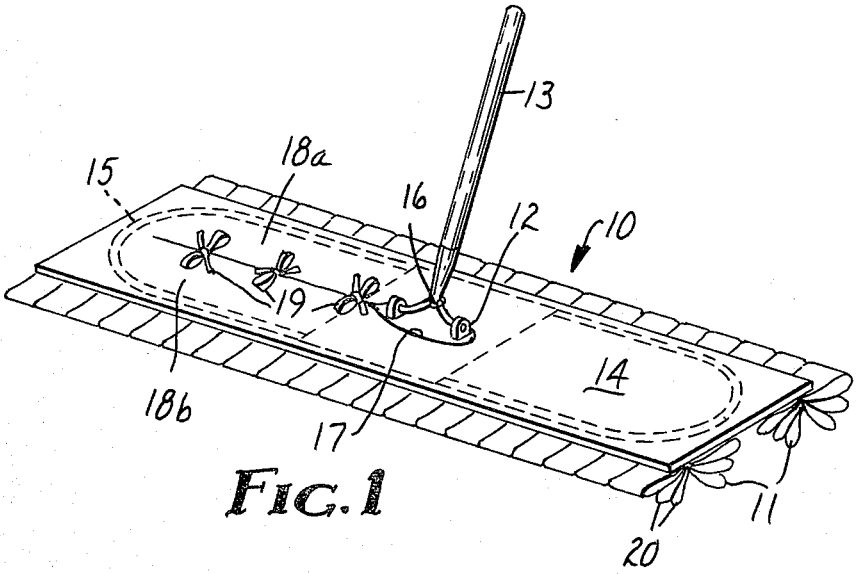
FIG. 1 is a perspective view showing the mop of the inventicn including a conventional mop handle frame assembly.
Figure 2:
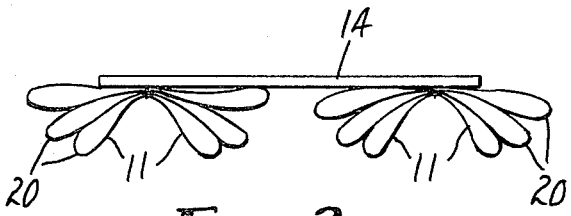
FIG. 2 is an elevational view of one end of the mop shown in FIG. 1.
Figure 3:
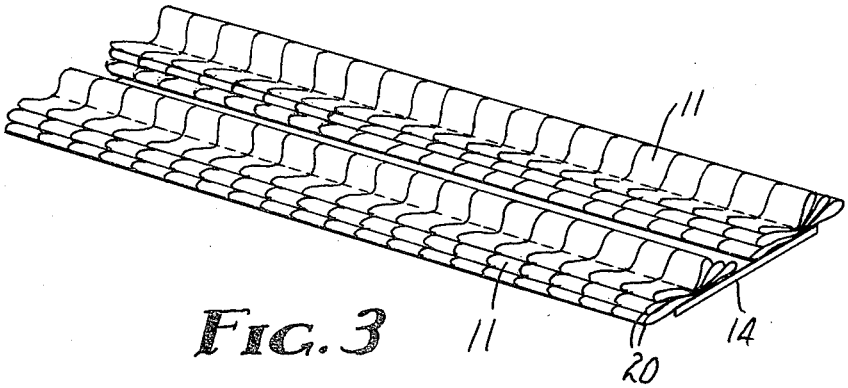
FIG. 3 is a perspective view showing the bottom surface of the mop depicted in FIG. 1.

Referring to FIGS. 1–3, there is shown a mop 10 which comprises a plurality of elongate, parallel side-by-side disposed dusting elements 11, a mop frame 12 including a handle 13 and a fastening means such as fabric pouch assembly 14. Frame 12 consists of an elongate wire loop 15 having a centrally disposed universal joint 16 which is fastened to handle 13. As shown in FIG. 1, pouch assembly 14 includes one side pouch 17 into which one end of wire loop 15 is inserted and abutted fabric segments **18*a* and 18*b* which open to permit insertion of wire loop 15 into the pouch 17. Suitable fastening elements, e.g., cords 19, are associated with fabric segments 18*a* and 18*b* to secure the segments together to prevent withdrawal of wire loop 15**. Such a frame design is conventional and other holding arrangements are also useful.

Each dusting element 11 is comprised of a substantially continuous elongate array of repeating segments of at least three dusting fabric ribbon loops 20 held together preferably in a fan-like array. Dusting elements 11 are held to mop frame 12 by a suitable fastening means which may include various engagement means such as pouches, backings, or mechanical fastening devices. The dusting fabric ribbon loop may be attached to such engagement means by stitching, tacking, adhesive bonding, ultrasonic welding, or the like.

Figure 4:
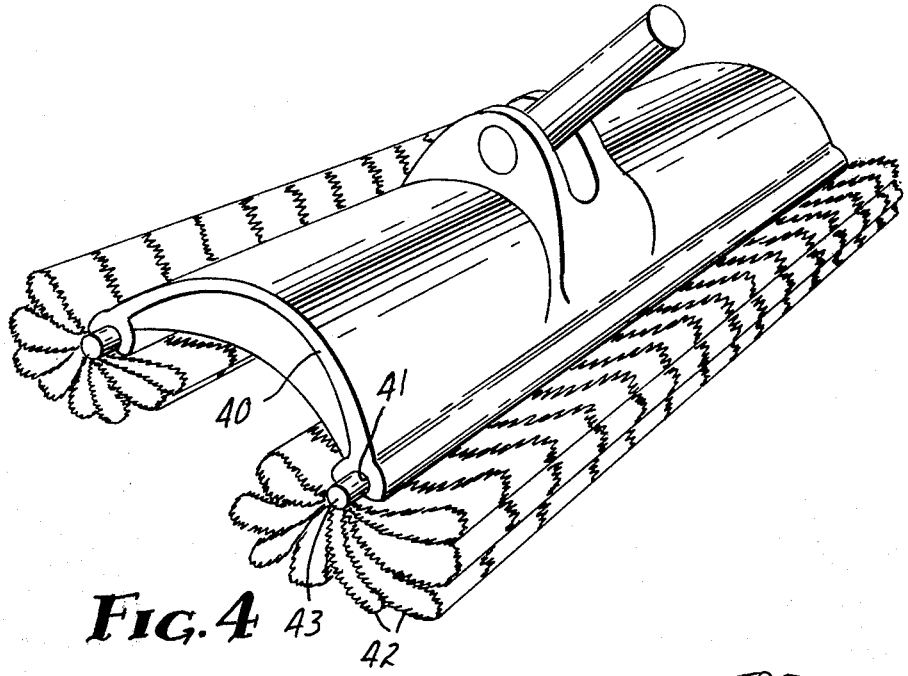
FIG. 4 is a perspective view showing another embodiment of the mop of the invention.
Figure 5:
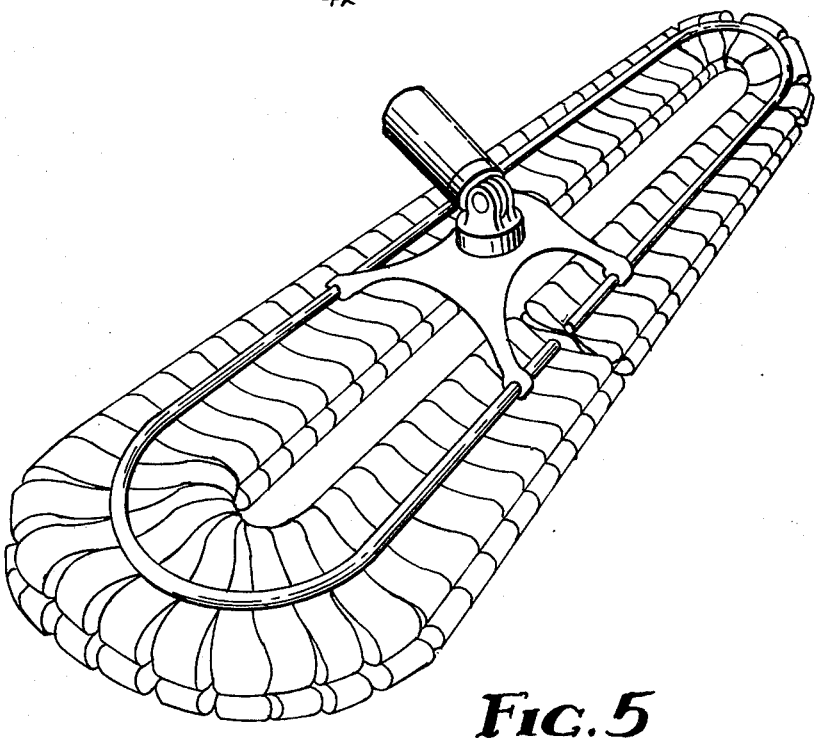
FIG. 5 is a perspective view showing yet another embodiment of the mop of the invention.

As depicted in FIGS. 4 and 5, other embodiments of the mop of the invention are contemplated and useful. For example, as depicted in FIG. 4, the dust mop frame may comprise a curved body 40 having downwardly projecting recesses 41 into which elongate dusting elements 42 may be engaged by bar 43.

Additionally, the elongate dusting elements may be joined on their ends to provide an oval-shaped ring having a front portion and a back portion which provide the dusting elements, as depicted in FIG. 5.

The dusting fabric ribbon loops are preferably formed by folding dusting fabric on itself in an accordion fashion to provide at least three elongate parallel fabric loops held together in a fan-like array and slitting each dusting fabric loop transversely at appropriate intervals to provide the dusting fabric ribbon loops. Continuous strips of dusting fabric ribbon may also be wound or deployed in an appropriate manner to provide the dusting elements.

The pouch or backing to which the dusting elements may be fastened may be a fabric element or an element made of materials such as cardboard, wood or plastic sheeting. The preferred pouch is formed of fabric to accommodate the engaging element, e.g., wire loop, of a conventional dust mop frame and has appropriate fastening devices such as string ties, as shown in FIG. 1 to temporarily hold the wire loop in place.

The preferred dusting fabric is formed of a blend of blown microfibers and crimped, bulk-providing macrofibers. A preferred dusting fabric for use in the present invention is disclosed in assignee's U.S. Pat. No. 4,118,531, the disclosure of which is incorporated herein by reference. Most preferably, the nonwoven fabric is reinforced by embossing as disclosed in Canadian Pat. No. 1,109,654.

Blown microfibers may be prepared according to techniques utilizing melt blowing or solution blowing. The microfiber blowing techniques are conventional and fabrics may be prepared by the methods disclosed, for example, in Wente, Van A. "Superfine Thermoplastic Fibers" in Industrial Engineering Chemistry, Vol. 48, pages 1342 et seq (1956), or in Report No. 4364 of the Naval Research Laboratories, published May 25, 1954, entitled "Manufacture of Superfine Organic Fibers" by Wente, Van A.; Boone, C. D.; and Fluharty, E. L. Typically, a melt blowing fiber-forming apparatus includes a die which has an extrusion chamber through which liquified fiber-forming material is advanced; die orifices arranged in a line across the forward end of the die into which the fiber-forming material is extruded, and incorporating gas orifices through which the gas, typically heated air, is forced at a very high velocity. High velocity gaseous streams draw out and attenuate the extruded molten fiber-forming material, whereupon the fiber-forming material solidifies as microfibers during travel to a collector. The collector is typically a finely perforated screen. Gas withdrawal apparatus may be positioned behind the screen to assist in deposition of fibers and removal of gas.

The crimped bulking fibers are introduced into the stream of blown microfibers through use of a lickerin roll disposed above the microfiber-blowing apparatus. A web of bulking fibers, typically a loose, nonwoven web such as prepared on a garnet machine or "Rando-Webber", is propelled along a table under a drive roll where the leading edge engages against the lickerin roll. The lickerin roll picks off fibers from the leading edge of the web separating the fibers from one another. The picked fibers are conveyed in an air stream through an inclined trough or duct and into the stream of blown microfibers where they become mixed with the blown microfibers. The air stream is generated inherently by rotation of the lickerin roll, or that air stream may be augmented by use of an auxiliary fan or blower operating through a duct.

Suitable dusting fabrics may also be provided by other materials such as 100% blown microfiber webs, paper, cotton, wool, and the like.

Generally, it is desired to employ more dusting fabric loops in a dusting element employing a softer dusting fabric since such dusting fabrics will tend to provide less bulk by using the minimum number of fabric loops.

Dusting fabric loops may also be formed by conventional bow-making processes for making decorative bows, e.g., the type used for applying to gift packages, and the bows fastened to a suitable frame by conventional means to provide the dusting elements.

The fabric loops may be stacked one on another in alignment or they may radiate from one point of attachment. The loops of dusting fabric may be twisted to provide additional bulk and the edges of the dusting ribbons may be straight or undulated.

It is preferred that at least one-half of the fabric loops of the dusting element comprising the leading edge of the mop extend forward from the leading edge and at least one-half of the fabric loops of the dusting element comprising the following edge of the dust mop extend from the following edge. This insures that there is a sufficient amount of fabric loops on the edges of the mop.

EXAMPLES

The invention is further illustrated by the following examples in which all parts are by weight unless otherwise specified.

EXAMPLE 1

A dust mop as depicted in FIG. 1 was prepared, employing a nonwoven dusting fabric web prepared according to the disclosure of aforementioned U.S. Pat. No. 4,118,531. The nonwoven web contained 50% by weight polypropylene blown microfibers having a diameter on the order of 0.2 to 4.3 micrometers and an average length of 1.2 micrometers and 50% by weight 14 decitex, 3.4 centimeters long polyethylene terephthalate macrofibers having 50% crimp. The nonwoven web had a fabric weight of 50 gram/m$^2$, 0.4 to 0.5 centimeter thickness (before embossing) and a loft of 80 to 110 cm$^3$/gram.

The nonwoven fabric was reinforced by rotary pressure embossing over 20% of its surface with a ½ inch high repeating connecting "JJ" pattern to fuse the polypropylene microfibers in the embossed area to thereby hold the macrofiber network in place.

A backing material to which the dusting fabric loops were fastened and from which the mop frame pouch was fashioned consisted of spunbonded polypropylene nonwoven fabric commercially available under the trade designation "Celestra" from the Crown Zellerback Company having a fabric weight of 2.0 ounces per square yard, a thickness of 16 mils and a grab tensile strength of 30 lbs.

A 38 inch long folded bundle was obtained by folding the short side of a 38 inch long by 24 inch wide piece of the dusting fabric sequentially onto itself in accordian fashion to form four 6 inch wide layers. Two of such folded bundles were laid side-by-side on a 10 inch by 38 inch segment of backing fabric with the closed loops facing outward and the fabric ends and adjacent loops facing inward and so that they were overlapped by one inch. The bundles were then attached to the backing material by ultrasonic welding using a ½ inch wide split bar stitch pattern longitudinally transversing the center of each folded bundle so that the parallel stitch lines were spaced 3½ inches apart. The mop head was then clamped to a holding jig and the fabric folds slit at ¾ inch intervals to form parallel ribbons. The backing was then sewn to form a pouch arrangement of the type shown in FIG. 1. to receive a conventional 5 inch by 36 inch wire mop frame.

EXAMPLE 2

An elongate dusting element was prepared for installation in the dust mop frame depicted in FIG. 4. A ¾ inch wide ribbon of dusting fabric was laid in an overlapping sinusoidal or flattened helical pattern across the face of the channel of an elongate U-shaped element adapted to be inserted into the downward facing dusting element-receiving slots of the mop frame depicted in FIG. 4. A wire was laid across the folds of the dusting fabric to force the fabric into the channel and the U-shaped element was crimped on both sides to lock the insertion into place. The crimped U-shaped element was then inserted into the dusting element-receiving channel of the mop frame.

We claim:

1. A mop especially adapted for collecting and pushing dust and fine dirt on and from smooth surfaces, said mop comprising:

(a) a plurality of dusting elements, each dusting element comprising a substantially continuous elongate array of repeating segments of at least three dusting fabric ribbon loops;

(b) a mop frame including a handle; and (c) fastening means for securing said dusting elements in a side-by-side relationship to said mop frame.

2. The mop of claim 1 wherein said dusting elements each comprise dusting fabric folded on itself at a point of attachment with said fastening means to provide at least three elongate parallel fabric loops held together, each dusting fabric loop being transversely slit to provide said dusting fabric ribbon loops.

3. The mop of claim 1 wherein each ribbon in said ribbon loops is at least ¾ inch wide.

4. The mop of claim 1 wherein at least one-half of said ribbon loops have a length of at least 5 inches.

5. The mop of claim 1 wherein said dusting fabric is a nonwoven fabric comprising a web of blown organic microfibers.

6. The mop of claim 1 wherein said dusting fabric comprises a blend of blown microfibers and crimped, bulk-providing macrofibers.

7. The mop of claim 1 wherein one edge of one of said dusting elements provides a leading edge and an opposite edge of another of said dusting elements provides a following edge and wherein at least one-half of the loops of said one dusting element extend from said leading edge and at least one-half of the loops of the other of said dusting elements extends from said following edge.

* * * * *